United States Patent [19]

Sommerer

[11] 4,227,863

[45] Oct. 14, 1980

[54] CENTRIFUGAL ASPIRATOR

[76] Inventor: Raymond Sommerer, 12221 N. 30th Ave., Phoenix, Ariz. 85029

[21] Appl. No.: 943,041

[22] Filed: Sep. 18, 1978

[51] Int. Cl.[3] ..... F04F 5/22

[52] U.S. Cl. ..... 417/169; 406/151; 417/171; 417/179

[58] Field of Search ..... 417/171, 181, 194, 169, 417/179; 239/405, 402, 403, 399, 472, 463; 406/151, 152, 92

[56] References Cited

U.S. PATENT DOCUMENTS

| | | | |
|---|---|---|---|
| 1,517,467 | 12/1924 | Schmidt | 417/171 X |
| 2,794,686 | 6/1957 | Anselman et al. | 406/92 X |
| 2,795,197 | 6/1957 | Laster et al. | 417/171 |
| 3,131,645 | 5/1964 | Dodge | 417/171 |
| 3,301,606 | 1/1967 | Bruno | 417/171 |

FOREIGN PATENT DOCUMENTS

| | | | |
|---|---|---|---|
| 115862 | 5/1918 | United Kingdom | 417/171 |

*Primary Examiner*—Carlton R. Croyle
*Assistant Examiner*—Edward Look
*Attorney, Agent, or Firm*—Cahill, Sutton & Thomas

[57] ABSTRACT

A centrifugal aspirator includes an enclosed cylindrical vortex chamber having a plurality of high pressure fluid inlets tangentially oriented with respect to a cylindrical wall of the vortex chamber, an intake inlet approximately centrally disposed in one end of the vortex chamber for conducting a conveying fluid and solid particles contained in the conveying fluid, and an exhaust outlet disposed along the cylindrical wall of the vortex chamber for exhausting a mixture of the high pressure injected fluid, the aspirated conveying fluid and the solid particles.

6 Claims, 5 Drawing Figures

CENTRIFUGAL ASPIRATOR

BACKGROUND OF THE INVENTION

1. Field of the Invention

The invention relates to aspirators, and more particularly, to centrifugal aspirators capable of efficiently aspirating a conveying fluid containing solid particles.

2. Description of the Prior Art

Various aspirators, sump pumps, jet pumps, dredging devices, and the like, are known in the prior art. Some of the known devices, such as those shown in U.S. Pat. Nos. 3,856,651 and 4,028,009, operate to create vortexes having low pressure vortex "cores" creating suction which conveys fluid containing solid particles, such as slurry or dredged material, into the vortex. Various means are utilized to exhaust the conveying fluid and solid particles therein from the vortex. However, such known devices are expensive and complex. There exists a need for an efficient, yet inexpensive aspirator capable of aspirating a conveying fluid containing solid particles. One known aspirator, manufactured by Keene Engineering, called a suction nozzle, is a relatively simple device which can be connected to a suction hose or tube to aspirate or dredge gravel. Many amateur and professional prospectors use such devices while prospecting for gold. The suction nozzle contains a suction tube having an approximate 30° bend, a suction inlet for drawing in dredged gravel and a connection to a hose for carrying a mixture of gravel and water to a sluice or the like. Water from a high pressure source is injected into the suction tube at the bent portion of the suction tube. However, this device, although inexpensive and simple, does not produce a suitably high level of suction, and is quite inefficient in that it requires a high ratio of volume of injected high pressure water to volume of dredged material.

It is therefore an object of the invention to provide an economical, simple aspirator which can aspirate or dredge conveying fluid containing solid particles with greater efficiency than aspirators of the prior art.

U.S. Pat. No. 2,565,907 discloses an apparatus which injects high pressure air tangentially into a vortex chamber, producing a low pressure vortex core which draws an aspirated fluid into the vortex and exhausts a mixture of the high pressure and an aspirated fluid (the term "fluid", as used hereinafter, can refer to either a gaseous fluid or a liquid fluid). This device, although simple and efficient (because of the characteristic low pressure vortex core), is unsuitable for dredging purposes or for aspirating any fluid containing solid particles because the solid particles are thrown centrifugally outward into the vortex chamber and therefore are not exhausted. Consequently, the device of U.S. Pat. No. 2,565,907 rapidly becomes clogged if used for dredging.

It is therefore another object of the invention to provide a simple, inexpensive aspirator which efficiently exhausts a fluid conveying solid particles having a higher specific gravity than the conveying fluid.

It is another object of the invention to provide a clog-free centrifugal aspirator.

U.S. Pat. No. 2,795,197 discloses an aspirator having a lower vortex chamber and an upper vortex chamber separated by a barrier, wherein tangentially injected high pressure fluid produces a vortex in the lower chamber to produce a vacuum which sucks the aspirated fluid into the lower vortex chamber. A mixture of the aspirated fluid and the injected fluid passes through a discharge orifice centrally disposed in the barrier separating the upper vortex chamber from the lower vortex chamber and is centrifugally exhausted by means of an exhaust port located in the cylindrical wall of the upper vortex chamber. This device, although simple and efficient for fluids which contain no solid particles, is totally unsuitable for dredging operations, because solid particles would rapidly clog the lower vortex chamber, thereby rendering the device inoperative.

It is another object of the invention to provide a centrifugal aspirator which avoids the problems of prior aspirators in dredging operations.

SUMMARY OF THE INVENTION

Briefly described, and in accordance with one embodiment thereof, the invention provides a centrifugal aspirator having an enclosed cylindrical vortex chamber, a high pressure inlet for tangentially injecting fluid at high velocity into the vortex chamber to produce a high velocity vortex having a low pressure vortex core, the centrifugal aspirator also having a conveying fluid inlet disposed at one end of the vortex chamber and aligned with an axis of the vortex, and an outlet through the cylindrical wall of the vortex chamber for exhausting a mixture of the injected fluid and the conveying fluid and any solid particles conveyed by the conveying fluid into the vortex via the conveying fluid inlet. A high level of turbulence in the vortex and the high velocity exhausting of fluid from the vortex via the outlet produces a high vacuum vortex core which initially sucks conveying fluid and solid particles contained therein efficiently into the vortex chamber and into the vortex to prime the centrifugal aspirator. Centrifugal force thrusts the solid particles against the inner cylindrical surface of the vortex chamber as the vortex rotates until the solid particles reach the outlet, whereat they are exhausted at high velocity, thereby leaving a vacuum in the vortex chamber. In one embodiment of the invention, a plurality of high pressure inlets are utilized to tangentially inject a plurality of high pressure fluid streams into the vortex chamber to produce a high velocity vortex having less turbulence in the vortex after the centrifugal pump is primed. The plurality of high pressure inlets are spaced around the outer wall of the cylindrical vortex chamber. In another embodiment of the invention, the inside diameter of the vortex chamber gradually increases from the upper and lower ends of the vortex chamber to the center thereof to prevent small particles from accumulating along the junctions between the ends of the vortex chamber and the inner cylindrical wall surface. In another embodiment of the invention, the plurality of high pressure inlets are fed by a unitary jacket-like manifold mounted in sealed relationship with the housing forming the vortex chamber. In another embodiment of the invention, the vortex chamber includes an upper, substantially cylindrical region and a lower cone-shaped region having a diameter gradually decreasing from the diameter of the cylindrical portion to the diameter of the conveying fluid inlet. A plurality of additional high pressure injection inlets are tangentially disposed along such lower portion of the vortex chamber to effect gradual, rather than abrupt acceleration of conveying fluid and particles contained therein to form the vortex, thereby decreasing turbulence in the vortex after the centrifugal pump is primed, and consequently increasing the efficiency of the centrifugal pump.

DESCRIPTION OF THE INVENTION

Figure 1:
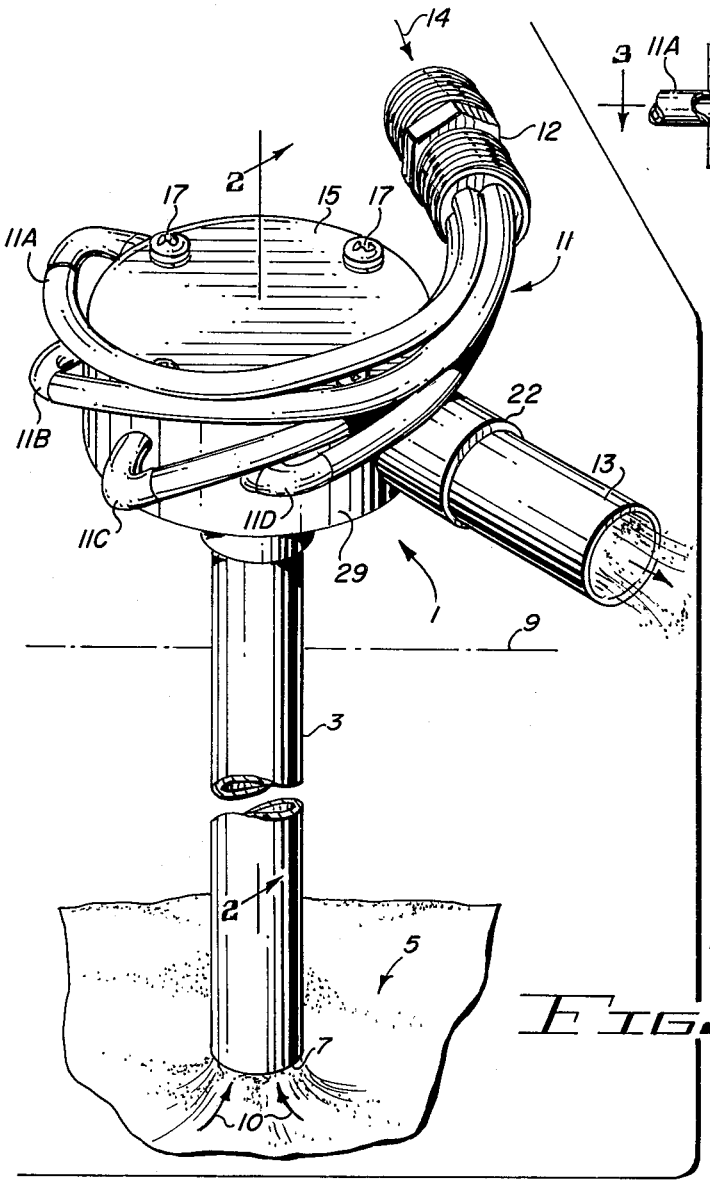
FIG. 1 is a partial perspective view of the centrifugal aspirator of the present invention.

Referring to FIG. 1, aspirator 1 includes an intake tube 3 having an open end 7 submerged beneath the surface of liquid 9. Aspirator 1 operates to suck, draw or dredge various solid particles 5 (such as sludge, gravel and the like) into open end 7 of intake tube 3, as indicated by arrows 10.

Figure 2:
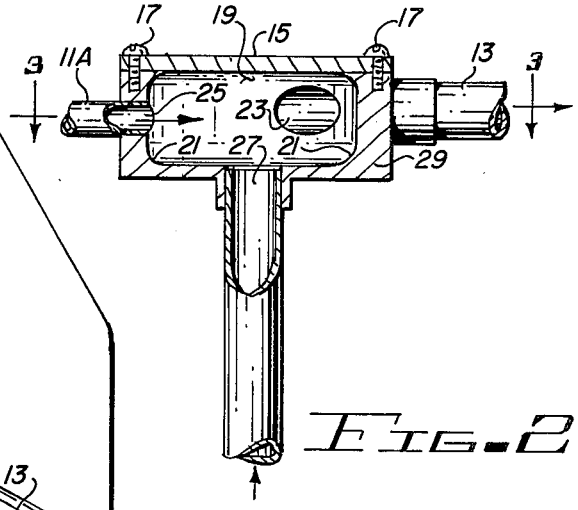
FIG. 2 is a partial sectional view taken along section lines 2—2 of FIG. 1.
Figure 3:
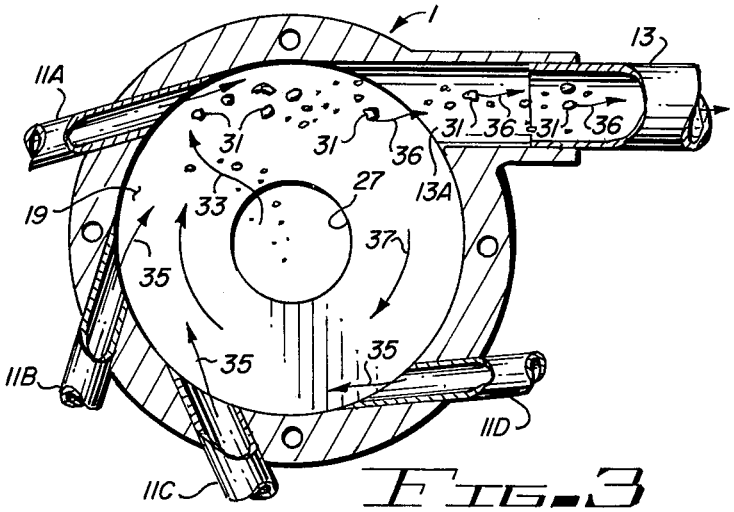
FIG. 3 is a partial sectional view of the centrifugal aspirator of FIGS. 1 and 2 taken along the section lines 3—3 of FIG. 2.

Intake tube 3 is connected to an inlet, referred to herein as a "conveying fluid inlet", in a bottom end of an approximately cylindrical vortex chamber 19 (see FIG. 2). Housing 29 encloses vortex chamber 19, as shown in FIGS. 2 and 3 (which show vertical and horizontal sectional views of aspirator 1). Intake tube 3 opens into vortex chamber 19, so that a conveying fluid and solid particles contained therein can be sucked into vortex chamber 19 by means of vacuum produced by the vortex, as subsequently explained.

The interior of vortex chamber 19 is approximately cylindrical, and has an upper end with a sealed cover plate 15 attached to housing 29 by means of screws 17. The bottom of vortex chamber 19 can be integrally formed with housing 29, as shown, or may be formed of a plate attached in a sealing relationship with housing 29 by means of screws (in the same manner as top plate 15).

Four spaced tangential high pressure inlets are provided in the cylindrical wall of housing 29 to permit injection of high velocity tangential streams of fluid in vortex chamber 19 to produce the swirling motion necessary to create a vortex. The four high pressure inlets are connected to inlet tubes 11A, 11B, 11C and 11D, respectively, which are connected by means of an adaptor 12 to a high pressure fluid source (not shown) so that high pressure fluid is forced into adaptor 12, as indicated by arrow 14.

The vortex produced by the above-mentioned tangential streams causes a swirling motion of fluid in chamber 19, as indicated by arrows 37 in FIG. 3. Any solid particles (generally designated in FIG. 3 by reference numeral 31) conveyed into vortex chamber 19 by means of conveying tube 3 are thrust outwardly against the interior cylindrical wall of vortex chamber 19. Such solid particles then are swept along the interior cylindrical wall of vortex chamber 19 by the vortex until they reach outlet opening 13 in housing 29. The particles' momentum then cause them to be exhausted via outlet tube 13, as indicated by arrows 36 in FIG. 3. The exhausting of space-occupying particles and fluid from vortex chamber 19 via outlet tube 13 tends to create a vacuum in the center or core region of the vortex. Turbulence initially created in the vortex by the tangential injection of high pressure fluid causes a high degree of mixing of the conveying fluid with the injected fluid, thereby also tending to increase the vacuum in the vortex core region as the mixture of injected fluid, conveying fluid and particles is exhausted via exhaust tube 13 until vortex chamber 19 is completely "primed" or filled with liquid.

Arrows 35 in FIG. 3 indicate the direction of injection of high velocity fluid pumped into tangential inlets 11A–11D, and arrows 37 indicate the rotational direction of the vortex produced by the tangentially injected high pressure high velocity fluid. The vortex core whereat the above-mentioned vacuum is produced is centered over inlet opening 27. Arrow 33 indicates the path that one of the particles 31 travels as it is drawn through intake tube 3 and inlet opening 27 and is thrust (by centrifugal force) to the periphery of the vortex.

It is noteworthy that the conveying fluid aspirated through intake or suction tube 3 can be either a liquid or a gas, either of which can convey solid particulates. Similarly, the high pressure injection fluid pumped into the system through input tubes 11A–11D can be either a liquid or a gas. For either liquid or gas fluids, the similar principles of fluid mechanics are applicable.

The aspirator 1 of FIG. 1 is operated by connecting the high pressure inlet adaptor 12 to a source of high pressure fluid, which may, for example, be water. The intake suction tube 3 may be connected to a hose or pipe which is inserted into an area to be dredged, aspirated, or simply evacuated of gases or fluid. A mixture of the material, including the conveying fluid and solid particles contained therein and the injected high pressure fluid will be exhausted via the exhaust tube 13.

The operation of the aspirator is such that the high velocity streams of liquid injected into vortex chamber 19 produces a vortex having a low pressure core region, which initially "primes" the pump by drawing conveying liquid through suction tube 3. When the suction tube 3 and vortex chamber 19 are filled, the rapidly rotating fluid acts somewhat like an impeller. After the centrifugal pump is "primed", as explained above, the conveying fluid and solid particles therein are rapidly accelerated into rotary motion by the swirling of the vortex and are thrown out of vortex chamber 19 via the exhaust port or outlet 13A, 13. The fluid and solid particles thrown outward to the exhaust port leave a vacuum in the vortex chamber, which vacuum draws more material into the vortex chamber via the input suction port.

Inner cylindrical wall 21 of vortex chamber 19 is slightly curved, as shown in FIG. 2, and the positioning of exhaust port 13 and opening 23 at the most outward location of vortex chamber wall 19 insures that all solid particles are rapidly exhausted through exhaust port 13, preventing clogging or buildup of solid particles in vortex chamber 19.

Figure 4:
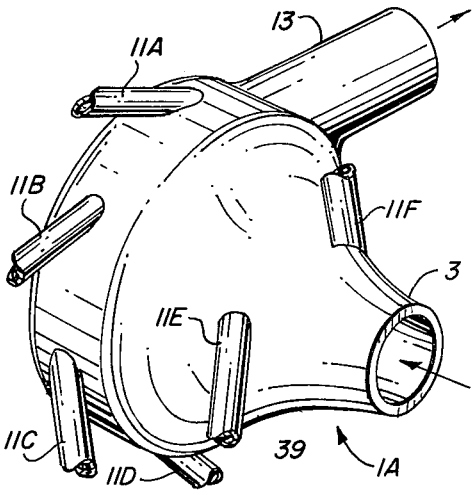
FIG. 4 is a partial perspective view of an alternative embodiment of the present invention.

An alternate embodiment of the invention is shown in FIG. 4, wherein vortex chamber 19 has a tapered subchamber 39 having additional high pressure tangential inlets such as 11E and 11F. Tapered chamber 39 permits gradual acceleration of conveying liquid and solid particles therein from the suction port 3 to the main (upper) cylindrical portion of the vortex chamber. Somewhat high operating efficiency after the device is primed is believed to result from this configuration due to reduced turbulence as aspirated fluid undergoes transition from the small diameter suction port 27 to the relatively large diameter vortex chamber 19.

Figure 5:
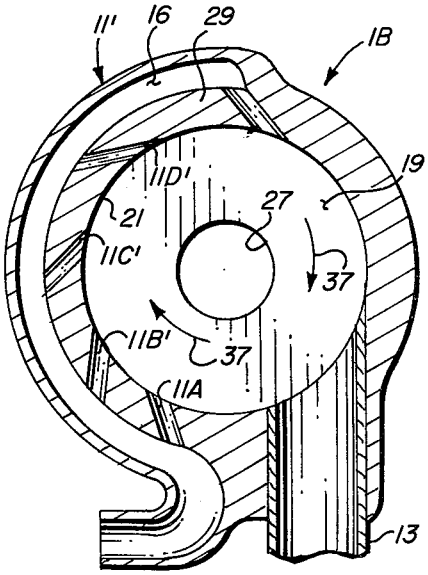
FIG. 5 is a partial sectional view of another embodiment of the centrifugal aspirator of the present invention.

FIG. 5 discloses an alternate configuration for the high pressure tangential inlets, which are provided as inclined inlet holes 11A'–11D' through wall 29 of the housing of the aspirator. The inlet holes 11A'–11D' are all continuous with a jacket or manifold 11' sealably fitted to housing 29 and having a tunnel 16. High pressure fluid is pumped into the aspirator of FIG. 5 through funnel 16.

While the invention has been described with reference to several embodiments thereof, those skilled in the art will recognize that various other arrangements of the described elements may be made within the true scope and spirit of the invention as set forth in the following claims.

I claim:

1. An aspirator for aspirating a first fluid, said first fluid being mixed with solid particles having a higher specific gravity than said first fluid, said aspirator comprising in combination:

a. an undivided chamber having an approximately cylindrical wall, said chamber having a first cover means for sealably engaging one end of said undivided chamber and a second cover means for sealably engaging an opposite end of said undivided chamber; said undivided chamber being bounded by interior surfaces of said approximately cylindrical wall and said first and second cover means such that any two points anywhere on said approximately cylindrical wall can be connected by a straight line which does not intersect any part of said first cover means or said second cover means;

b. a suction inlet approximately centrally disposed in said second cover means;

c. first conducting means for conducting said first fluid and said solid particles directly into said undivided chamber through said suction inlet, there being no portion of said first cover means said second cover means or said first conducting means obstructing passage of any of said solid particles through said first conducting means into said undivided chamber;

d. a high pressure inlet in said approximately cylindrical wall;

e. second conducting means for tangentially injecting a second fluid through said high pressure inlet directly into said undivided chamber to produce a vacuum producing vortex in said undivided chamber, said first fluid and said solid particles being forced into said vortex via said suction inlet in response to said vacuum to mix said first and second fluids and said solid particles together, said solid particles being centrifugally forced to circulate about the periphery of said vortex along the inner surface of said cylindrical wall; and f. an outlet in said approximately cylindrical wall for exhausting a mixture of said first fluid, said second fluid, and said particles from said undivided chamber without buildup of any of said solid particles anywhere in said undivided chamber.

2. The aspirator of claim 1 including a plurality of high pressure inlets in said cylindrical wall for injecting said second fluid through said plurality of high pressure inlets directly into said undivided chamber to produce said vacuum producing vortex, each of said plurality of high pressure inlets being spaced from the others of said plurality of high pressure inlets.

3. The aspirator of claim 2 further including a plurality of additional conducting means for tangentially injecting said second fluid through said plurality of high pressure inlets, respectively.

4. The aspirator of claim 1 wherein the diameter of said suction inlet is larger than the diameter of said high pressure inlet, whereby said injected second fluid moves at a substantially higher velocity than said first fluid.

5. The aspirator of claim 1 wherein said undivided chamber further includes a tapered approximately cone-shaped wall having a diameter which gradually decreases from the diameter of the cylindrical portion of said undivided chamber to the diameter of said suction inlet so that particles in said first fluid are gradually accelerated from said first inlet to the peripheral portions of said vortex, thereby reducing turbulence in said vortex.

6. The aspirator of claim 5 further including a plurality of tangentially inclined high pressure inlets in said tapered, approximately cone-shaped portion of said housing for tangentially injecting said second fluid into said tapered, approximately cone-shaped portion of said vortex chamber to aid in gradually accelerating said particles.

* * * * *